US009446529B2

(12) United States Patent
Tancredi et al.

(10) Patent No.: US 9,446,529 B2
(45) Date of Patent: Sep. 20, 2016

(54) APPARATUS FOR TRANSVERSALLY SAWING A TUBULAR BODY

(75) Inventors: Antonio Tancredi, Lamporecchio (IT); Stefano Benvenuti, Lamporecchio (IT)

(73) Assignee: GA.VO MECCANICA S.r.l., Larciano (PT) (IT)

( * ) Notice: Subject to any disclaimer, the term of this patent is extended or adjusted under 35 U.S.C. 154(b) by 221 days.

(21) Appl. No.: 14/234,480

(22) PCT Filed: Jul. 23, 2012

(86) PCT No.: PCT/IB2012/053748

§ 371 (c)(1),
(2), (4) Date: Jan. 23, 2014

(87) PCT Pub. No.: WO2013/017987

PCT Pub. Date: Feb. 7, 2013

(65) Prior Publication Data

US 2014/0174266 A1 Jun. 26, 2014

(30) Foreign Application Priority Data

Jul. 23, 2011 (IT) ..... PI2011A0084

(51) Int. Cl.
*B26D 3/16* (2006.01)
*B26D 7/02* (2006.01)
(Continued)

(52) U.S. Cl.
CPC ..... *B26D 3/16* (2013.01); *B26D 3/164* (2013.01); *B26D 7/02* (2013.01); *B26D 7/0616* (2013.01);
(Continued)

(58) Field of Classification Search
CPC ..... B62D 3/16; B62D 3/161–3/169; B62D 45/00; B62D 45/12; B62D 45/124; B62D 47/04; B62D 47/06; B62D 47/065; Y10T 82/16098; Y10T 82/16655; Y10T 82/16967
USPC ..... 82/50, 52, 59, 70, 70.2, 79, 90, 101, 82/102; 83/54
See application file for complete search history.

(56) References Cited

U.S. PATENT DOCUMENTS 1,711,942 A * 5/1929 Hawkins ..... B23D 45/124 269/52
3,018,678 A * 1/1962 Hankin ..... B23D 21/00 82/101

(Continued)

FOREIGN PATENT DOCUMENTS

DE 19933107 A1 * 2/2001 ..... B23D 45/027

OTHER PUBLICATIONS

International Search Report mailed Dec. 21, 2012, corresponding to International Application No. PCT/IB2012/053748.

*Primary Examiner* — Daniel Howell
*Assistant Examiner* — Nicole N Ramos
(74) *Attorney, Agent, or Firm* — Ladas & Parry LLP

(57) ABSTRACT

Technical problem: a low sawing precision of tubular bodies of an apparatus comprising a transverse sawing station (30), in particular said apparatus equipped with a chip-forming saw means (35), a support (11',11") arranged to maintain the tubular bodies (1) in rotation during the sawing step, and also comprising a carriage means (50) for carrying the tubular body (1) along the direction of its own longitudinal axis (16) towards the sawing station (30), in particular preserving the possibility of removing chips produced during the sawing from the inside of the tubular body (1), such low sawing precision, in terms of length and smoothness of the end of the portions depending upon possible small longitudinal translation movements of the tubular body (1) along the support (11',11").

Solution: providing a carriage means (50) that comprises a holding means (14) for longitudinally holding the tubular body (1), the holding means (14) comprising a rotatable element (71) arranged to relatively rollingly engage with a surface portion (18) of the tubular body (1), in particular the rotatable element (71) is arranged to engage by rolling and pressing onto an inner surface portion (18) of said tubular body (1) proximate to said first end (5') and radially corresponding to a surface portion of the tubular body (1) to contact a counter-support element (72) and radially corresponding to a surface portion of said tubular body (1) that is in contact with a counter-support element (72).

15 Claims, 9 Drawing Sheets

(51) Int. Cl.
*B26D 7/18* (2006.01)
*B26D 7/06* (2006.01)
*B26D 7/00* (2006.01)

(52) U.S. Cl.
CPC ..... *B26D 7/1863* (2013.01); *B26D 7/06* (2013.01); *B26D 2007/0018* (2013.01); *Y10T 82/16098* (2015.01); *Y10T 82/16426* (2015.01); *Y10T 82/16655* (2015.01); *Y10T 82/16967* (2015.01)

(56) References Cited

U.S. PATENT DOCUMENTS 3,839,931 A * 10/1974 Herpich ..... B23D 21/14 82/102
3,850,058 A * 11/1974 Bachmann ..... B23D 21/00 82/101
3,911,768 A * 10/1975 Kawano ..... B23B 31/1175 82/101
4,517,867 A * 5/1985 Fuminier ..... B23D 21/00 30/94
4,827,816 A * 5/1989 Takaniemi ..... B26D 3/16 82/101
5,458,031 A * 10/1995 Wolff ..... B26D 3/164 82/101
5,894,771 A * 4/1999 Braun ..... B23B 5/14 82/113
6,101,910 A 8/2000 Nicolai et al.
6,698,322 B2 * 3/2004 Borzym ..... B23D 21/14 83/54
6,752,055 B2 * 6/2004 Borzym ..... B23B 21/14 83/161
7,398,716 B2 * 7/2008 Quigley ..... B26D 21/14 82/102
2002/0178884 A1 * 12/2002 Chuang ..... B23D 45/10 83/24
2010/0032099 A1 2/2010 Tancredi et al.

* cited by examiner

A-A

A-A

APPARATUS FOR TRANSVERSALLY SAWING A TUBULAR BODY

FIELD OF THE INVENTION

The present invention relates to an apparatus for transversally sawing tubular bodies, for example tubular cores for supporting coils of wound material.

DESCRIPTION OF THE TECHNICAL PROBLEM

Apparatuses are known for transversally sawing tubular bodies made of such materials as pressed cardboard or plastics, which are well suited for serving as cores for supporting coils of tape material, for example. These apparatuses are normally equipped with a transverse chip-forming saw device, in particular they are equipped with circular rotating blades.

In order to obtain a maximum sawing precision, as well as smoother and more regular end portions of the sawn tubular bodies, a device is normally provided for bringing into rotation the tubular bodies about their own axis while performing a sawing operation by the blade.

Examples of such apparatuses can be found, for instance, in IT1314837 and in WO2008/114115.

These apparatuses comprise a cradle or a roll conveyor consisting of parallel idle rollers on which each tubular body or tube is laid. A peripheral friction drive roller is provided for rotating the tube about its own axis, whereas a pusher means is provided for longitudinally shifting the tube.

This way, in order to obtain a tube portion of a predetermined length, the tube is caused to shift longitudinally by a pusher beyond the blade for such length. Then, the pusher stops and the tube is sawn while it rotates about its own axis.

However, in these conditions, the tube is free to move longitudinally during the sawing operation or even immediately before the sawing operation. One cause for this longitudinal movement may be an imperfect alignment of the longitudinal rollers. In fact, the tube remains in the prefixed working position only if the axes of the apparatus, in particular the axes of the cradle idle rollers and of the drive roller are accurately aligned, and only if the rollers are manufactured with high dimensional precision.

Even small longitudinal displacements from the working position may deteriorate the sawing precision, in particular the precision of the length of the sawn-away tubular portion that are obtained. With the manufacturing and mounting tolerances that can be normally obtained, the improved machines of the type described in the above documents allow to attain a sawn-away portion length precision of about one-tenth of a millimeter. This is a typical desired value for pressed cardboard tubular bodies.

However, a better precision is required for some well-know applications of cardboard tubes, where the length tolerances must be lower than one-tenth of a millimeter. This condition is extremely difficult or substantially impossible to achieve by optimizing the construction of the existing equipment.

Furthermore, a chip-forming sawing operation requires removing sawdust and saw chips from the inside of the tubular bodies, in particular once the sawing operation is over. This is normally carried out by a suction means, therefore a suction passageway should be arranged between the outside and the inside of the tube.

SUMMARY OF THE INVENTION

It is therefore an object of the present invention to provide an apparatus for transversally sawing a tubular body with formation of chips, for example for transversally sawing a tube to obtain a core element to support a wound material, in which the tubular body, before and during the sawing step, cannot substantially move in a longitudinal direction with respect to a prefixed working position, in order to obtain a sawing precision higher than what is possible by using a prior art apparatus.

It is a particular object of the invention to provide such an apparatus that allows length tolerances of the sawn tubular bodies better than one-tenth of a millimeter, in particular in the case of tubular bodies made of pressed cardboard.

It is also an object of the invention to provide such an apparatus that enables suction of sawdust and saw chips from the inside of the tubular body during the sawing.

It is also an object of the present invention to provide such an apparatus that does not require changing components or does not require particular adjustments and calibrations in case of change of the diameter of the tubular bodies to be processed.

It is also an object of the present invention to provide such an apparatus that does not occupy important radial spaces outside of the tubular body that is processed.

These and other objects are achieved by an apparatus for transversally sawing a tubular body into tubular portions, in particular for transversally sawing a tubular core for coils of wound material, comprising:

a carriage means for moving the tubular body to a sawing station, the carriage means arranged to engage with a first end of the tubular body and to longitudinally move the tubular body so that a second end of the tubular body is brought beyond the sawing station for a predetermined distance, said distance corresponding to a predetermined sawing length of a tube portion;

a support means that is arranged to receive the tubular body and to provide a support to it at the sawing station, and to allow a rotation of the tubular body about its own longitudinal axis;

a rotation means for bringing into rotation and maintaining in rotation the tubular body about its own longitudinal axis when said tubular body is located at the sawing station;

a saw means for sawing the tubular body in the sawing station, in order to obtain a sawn-away portion of the tubular body of the same length as said distance, wherein the main feature of the apparatus is that the carriage means comprises a holding means for longitudinally holding the tubular body along the support means, the holding means comprising a rotatable element arranged to relatively rollingly engage with a surface portion of the tubular body.

This prevents the tubular body from moving longitudinally. This way, it is possible to predetermine the length of the sawn-away tubular portions more precisely than what is possible by the prior art equipment. Moreover, this dimensional precision can be obtained even if the construction tolerances of the parts of the apparatus, and/or the mounting tolerances, are stricter than the tolerances commonly used in the manufacture of conventional equipment. For instance, it is possible to obtain sawn-away tubular portions of a predetermined length, for example pressed cardboard tubular portions, with better tolerances than one-tenth of a millimeter.

The longitudinal holding device of the tubular body acts only on a boundary portion of the tube cross section, therefore it does not substantially affect the diameter of the tube. For this reason, it offers advantages over a self-centring mandrel. In fact, at each operation, the self-centring mandrels require determining the position of the centre, and must be adapted to the diameter of the tube, in order to ensure a suitable centring. In some instances, the mandrel must even be replaced with another one of a size suitable for the diameter of the tube to be sawn.

Therefore, by the holding means according to the invention, it is possible to process tubes of various diameters without either replacing mechanical parts or adjusting or calibrating the apparatus.

Furthermore, the holding means according to the invention does not occupy space outside of the tubular body, therefore it does not create any interference with other parts of the apparatus, for instance with the rollers of a support cradle. Moreover, no special construction is required to avoid these interferences, as it would be the case with a self-centring mandrel.

In an exemplary embodiment, the rotatable element is arranged to engage by rolling and pressing onto an inner surface portion of the tubular body proximate to the first end, in particular the rotatable element is arranged to engage by rolling and pressing onto an inner surface portion of the tubular body proximate to the first end and radially corresponding to a surface portion of the tubular body that is in contact with a counter-support element.

Advantageously, the carriage means is configured to translate parallel to the support means between a first position, at a maximum distance from the sawing station, and a second position, at a minimum distance from the sawing station, wherein a loading means is provided for loading a tubular body to be sawn at a loading position set between the first and the second position.

Preferably, the saw means comprises a chip-forming sawing device, for example a blade or a toothed saw. In particular, the saw device may comprise a circular saw that is rotatably arranged about an axis that can be arranged parallel to the longitudinal direction.

Advantageously, the apparatus comprises, especially in this case, a suction means for removing chips that are produced by the saw means. The suction means is arranged within the carriage means, in order to suck, at the first end, chips that are produced at the second end, through the tubular body, in particular the carriage means comprising a plate configured to be arranged adjacent to the first end. The suction means may comprise a flow aperture in the plate, the flow aperture configured to provide an air suction mouth towards the first end.

In particular, the suction means comprises a fixed suction station that is connected to a movable tube extending as a rolling chain from the carriage means, in order to accumulate the sucked chips in the fixed suction station.

The holding device, which comprises a rotatable element, makes it possible to stop the longitudinal slide movement of the tube along the support means and at the same time allows to leave a flow aperture open at the second end of the tubular body, of a size large enough to allow the passage of a duct for sucking the saw chips from the inside of the tube, which form in significant amounts if a saw means is used of the above mentioned type. A different holding system, such as an expansion mandrel, even though it does not create any encumbrance outside of the tubular body, would occupy substantially the whole end section, and would therefore not allow any free passage for sawdust and saw chips suction.

In particular, the toothed circular blade is mounted on a carriage that is transversally slidable with respect to the longitudinal direction. Advantageously, an actuation means is provided for moving the carriage according to a faster approach stroke and a slower sawing stroke.

In particular, the rotatable element is a roller configured to rotatably and frictionally engage with the inner surface.

In an exemplary embodiment, the rotatable element has a profile configured to emboss the material of the inner surface of the tubular body, to make a rolling track for the rotatable element that provides a precise longitudinal reference, in particular the roller has an incision means that is configured to make a circular notch in the inner surface. In particular, the incision means comprises a cutting edge that circumferentially extends along the rotatable element. For instance, the cutting edge has a triangular or trapezoidal cross section.

In particular, the support means comprises a cradle comprising two elongated rollers that are longitudinally and rotatably arranged parallel to each other, in order to receive the tubular element laying by gravity and parallel onto the rollers.

Preferably, and in particular in this case, the inner surface portion of the tubular body, with which the rotatable element is configured to engage, is a lowermost portion, and a passageway is provided for the carriage means between the two rollers.

Advantageously, an adjustment means is provided for adjusting the radial position of the rotatable element with respect to the tubular body, said adjustment means configured to cause the rotatable element to rollingly engage with an inner surface portion of the tubular body by pressing on it, said portion having a predetermined thickness. In particular, the radial position adjustment means comprises a retaining means for retaining the rotatable element at a central position and a recall means for recalling the rotatable element towards a peripheral position of the rotatable element, the recall means adapted to intervene recalling the rotatable element into contact with the inner surface portion of the tubular body. This way, the machine is easily adaptable to the thickness of the tubular body. The tape-retaining means may be a pneumatic means, while the recall means may be a resilient means or of a magnetic means.

Moreover, a scrap expulsion station may be provided at a first movement position of the carriage means at a remote position with respect to the sawing station, in particular the scrap expulsion station comprises a pusher configured to push the scraps transversally with respect to a conveying direction of the carriage means.

Advantageously, the sawing station comprises a position sensor, for example an optical position sensor, which is arranged to detect the position of the carriage means and/or of the tubular body being processed.

Advantageously, in the sawing station a means is provided for reversing the rotation speed of the tubular body during the sawing once the tubular body has rotated by a predetermined angle. This way, it is possible to obtain a very high sawing precision. In particular, this predetermined angle exceeds 360°, in particular is set between 380° and 390°.

In an exemplary embodiment, a tubular body feeding means is provided comprising an elongated member that has a star-shaped cross section and comprises at least three continuous radial protrusions. The elongated member is adapted to rotate about an own longitudinal axis parallel to the longitudinal axis. The continuous protrusions may extend along the whole length of the star-shaped member. In particular, the star-shaped member may have four protrusions, that are sequentially arranged at a right angle with respect to each other.

The rollers of the cradle are mounted at a height lower than the longitudinal axis of the star-shaped member, such that a tubular body is released on the cradle after a predetermined rotation of the star-shaped body has occurred.

BRIEF DESCRIPTION OF THE DRAWINGS

The invention will be now shown with the following description of an exemplary embodiment thereof, exemplifying but not limitative, with reference to the attached drawings, in which.

DESCRIPTION OF A PREFERRED EXEMPLARY EMBODIMENT

Figure 1:
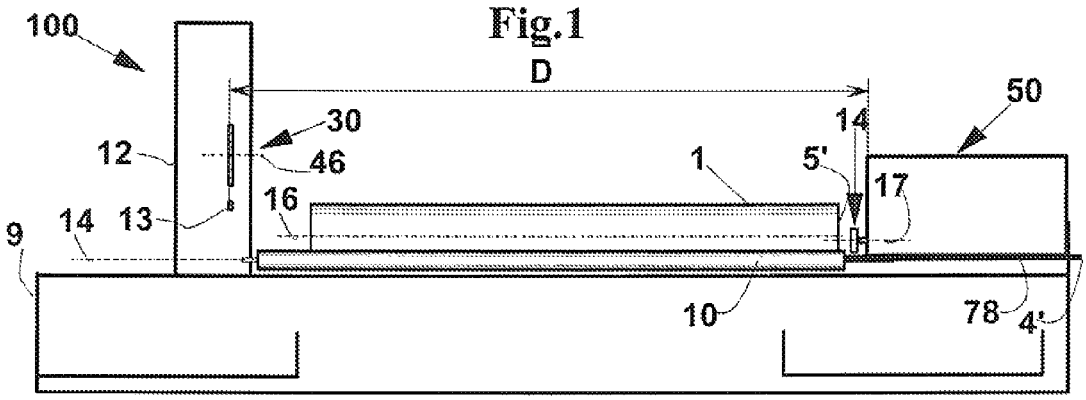
FIGS. 1 to 4 are diagrammatical side views of an apparatus according to the invention, where a carriage means is shown for moving forward a tubular body between a rest or load position and a first saw position.

With reference to FIGS. 1 to 14, an apparatus 100 is described for transversally sawing a tubular body 1, for instance, for sawing cores to support a wound material. These bodies or tubular cores may be made of various materials, such as pressed cardboard or a plastic material like PVC.

Apparatus 100 comprises a frame 9 on which a support 12 is arranged for a sawing station 30. In particular, sawing station 30 comprises a chip-forming sawing device. For example, sawing station 30 comprises a circular saw or blade 35 that is rotatably arranged about an own axis 46, for carrying out a transverse sawing operation of tubular body 1 with formation of chips. In particular, sawing station 30 may be equipped and may work as described in IT1314837 or in WO2008/114115.

Below sawing station 30, a means 19' may be provided for collecting sawn-away portions 1' obtained by transversally sawing tubular body 1.

Apparatus 100 has a load means for loading tubular bodies to be sawn, for instance a conventional load means 26, as described more in detail hereinafter, with reference to FIGS. 16 and 19.

Figure 5:
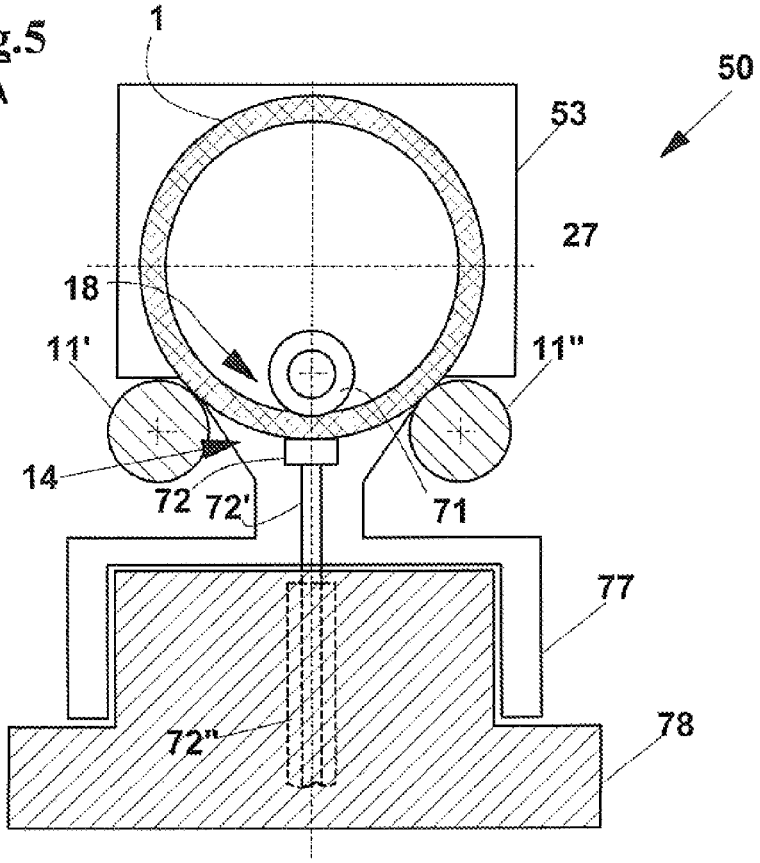
FIG. 5 is a diagrammatical front sectional view of a slide carriage means and of a support of the apparatus of FIGS. 1-4
Figure 10:
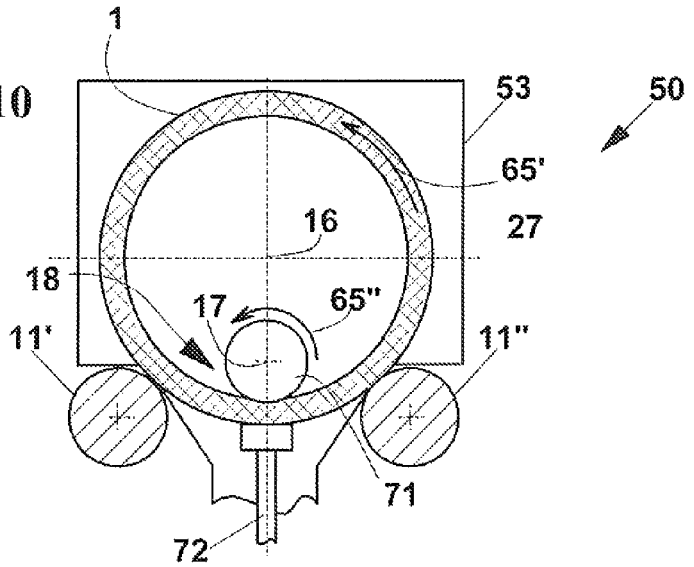
FIG. 10 is a partial front view similar to the view of FIG. 5, in a saw configuration of the tubular body 1.

Transverse sawing apparatus 100 also comprises a support 10 that is configured to receive a tubular body 1 from the load means. The support is made in such a way to allow a rotation of tubular body 1 about its own longitudinal axis 16 during the transverse sawing, in order to assist this step. For example, as shown in FIGS. 5, 10 and 19, support 10 consists of a couple of rollers 11',11" that are rotatably arranged about respective axes 14', 14".

Figure 2:
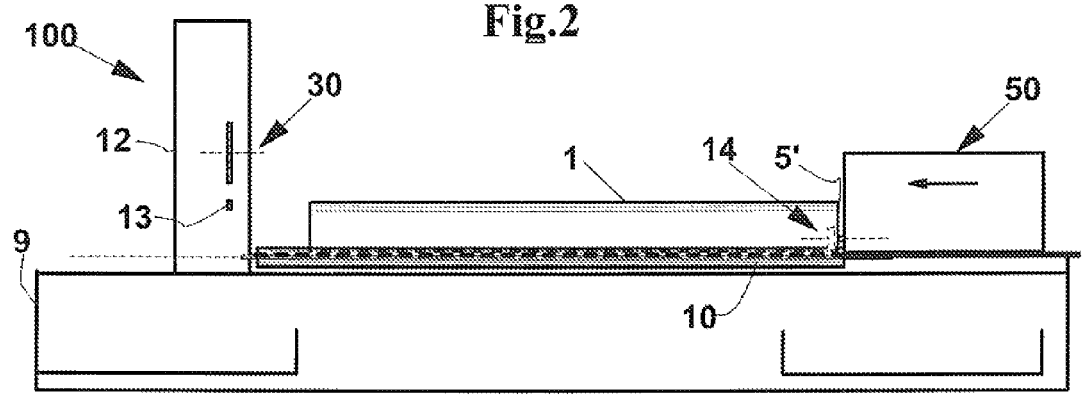

In FIG. 1 a tubular body 1 to be sawn is shown laying on support 10, in a step subsequent to the loading. Carriage means 50 can also be seen in FIG. 1, for moving tubular body 1 forward from the load position of FIG. 1 towards saw means 35. The carriage means can shift towards saw means 35, according to the direction indicated by the arrow 58 of FIG. 2. For example, the carriage means may have the form of a carriage, or may have the form of a slide element 50 that can longitudinally slide on apparatus 100, as in the represented exemplary embodiments. Slide element 50 is configured to engage with a first end 5' of tubular body 1, as shown in FIG. 2. This way, carriage means 100 can shift tubular body 1 towards sawing station 30.

Figure 3:
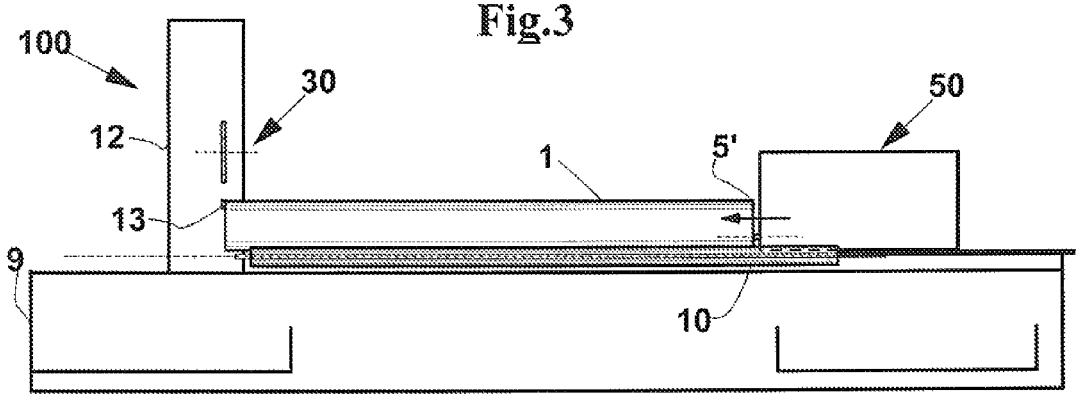

In FIG. 3 an intermediate position is shown of a step of approaching to the sawing device, at which a proximity sensor 13 is present, for example an optical sensor, which is configured to detect the passage of a second end 5" of tubular body 10 while approaching to the sawing station.

Figure 4:
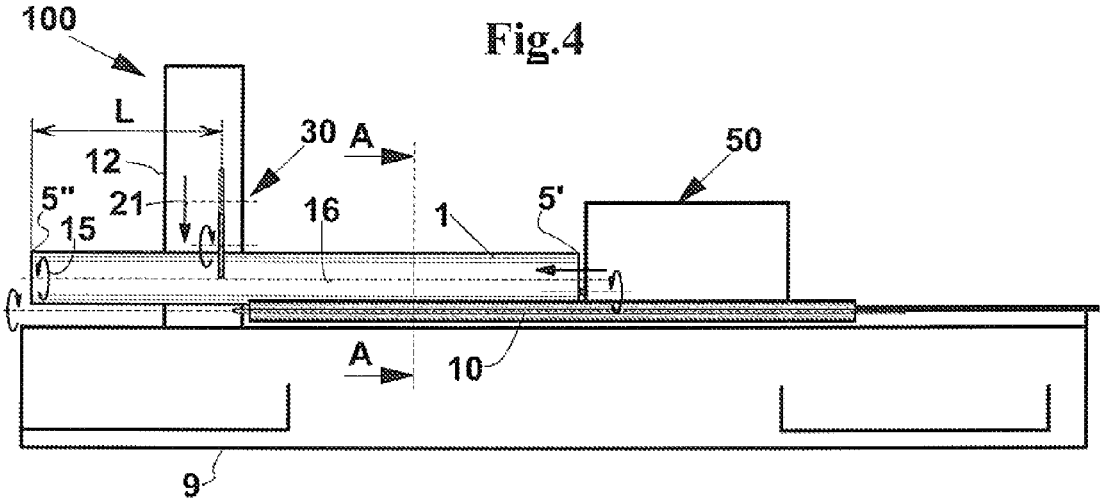

As shown in FIG. 4, carriage means 50 can longitudinally move forward tubular body 1 such that second end 5" travels for a predetermined distance L beyond sawing station 30, which corresponds to a predetermined sawing length of a first tube portion 1' to be sawn away. Carriage means 50 is stopped at the first saw position of FIG. 4 by a program means, not shown, which is configured to learn the predetermined value of length L, and to receive a reference or zero signal provided by proximity sensor 13 when end 5' of tubular body 1 reaches the measure position of FIG. 3. Moreover, the program means is arranged to operate the shift movement actuation means of slide element 50 when the latter has travelled by distance L towards sawing station 30.

Once tubular body 1 has been arranged in the saw position of FIG. 4, the sawing device is actuated. In particular, circular saw 35 is brought into rotation about its own axis 46, and moves towards the tubular body according to a movement that is indicated by a vertical arrow 21 for the sake of clearness of the drawing, in any case the movement of circular saw 35 may also have a horizontal component. In other words, saw 35 is laterally and/or vertically displaced, according to the configuration of sawing station 30, towards tubular body 1, until a transverse sawing is accomplished to obtain a first sawn-away portion 1'.

By the expression "transverse sawing" a sawing step is meant that comprises cutting tubular body 1 at all its generatrices, but not necessarily according to a cut plane perpendicular to longitudinal axis 16 of tubular body 1, as diagrammatically shown in the drawings. In other words, saw means 35 may be arranged to execute a cut according to at least one cut plane at an angle with respect to longitudinal axis 16 of tubular body 1, in particular circular saw 35 may be arranged according to a plane at an angle with respect to axis 16, by actuating a conventional angular positioning means, not shown, of circular saw 35.

Figure 6:
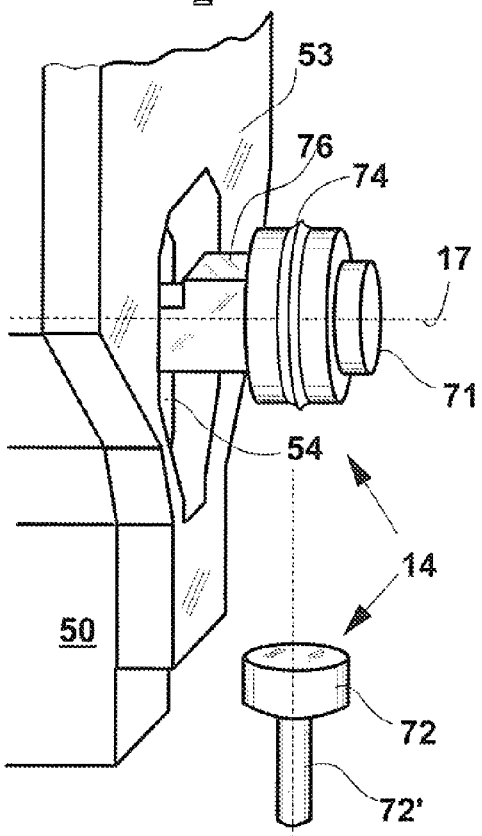
FIG. 6 is a perspective view of a front detail of a slide element with a longitudinal holding means for a tubular body.

According to the invention, as FIGS. 5 and 6 show, slide element 50 or another carriage device for moving forward tubular body 1, comprises a holding means 14 for longitudinally holding tubular body 1. Such a holding means can avoid any longitudinal shift movement of tubular body 1 with respect to support 10, in particular during the sawing step. Longitudinal holding means 14 comprises a rotatable element 71 that has a rotation axis 17, about which it can rotate, preferably, in an idle way. Rotatable element 71 can engage with a surface portion 18 of tubular body 1 in a rolling contact. Such a rolling contact engagement is maintained during the rotation of tubular body 1 about its own axis 16, wherein rotatable element 71 rotates about its own axis along with tubular body 1.

In particular, the cross sectional view of FIG. 5 diagrammatically shows a guide element 78 integral to the frame of apparatus 100, and a grip element 77 of slide element 50 arranged to slidingly engage with guide element 78.

Rotatable element 71 protrudes from a front plate 53 of slide element 50 through a hole 54. In slide element 50 a means is arranged for vertically displacing rotatable element 71 between a raised position (FIG. 6), and a lowered position (FIG. 7).

In the exemplary embodiment, as depicted, longitudinal holding means 14 advantageously also comprises a countersupport member 72, that is arranged to vertically slide between a lowered position (FIG. 6), and a raised position (FIG. 7), for example by means of a piston 72' that is slidably arranged within a cylinder 72".

FIG. 6 shows configuration of longitudinal holding means 14, i.e. the position of rotatable element 71 and of countersupport member 72 when the same does not engage with tubular body 1, for example in the position that immediately follows the loading, which is shown in FIG. 1.

Figure 7:
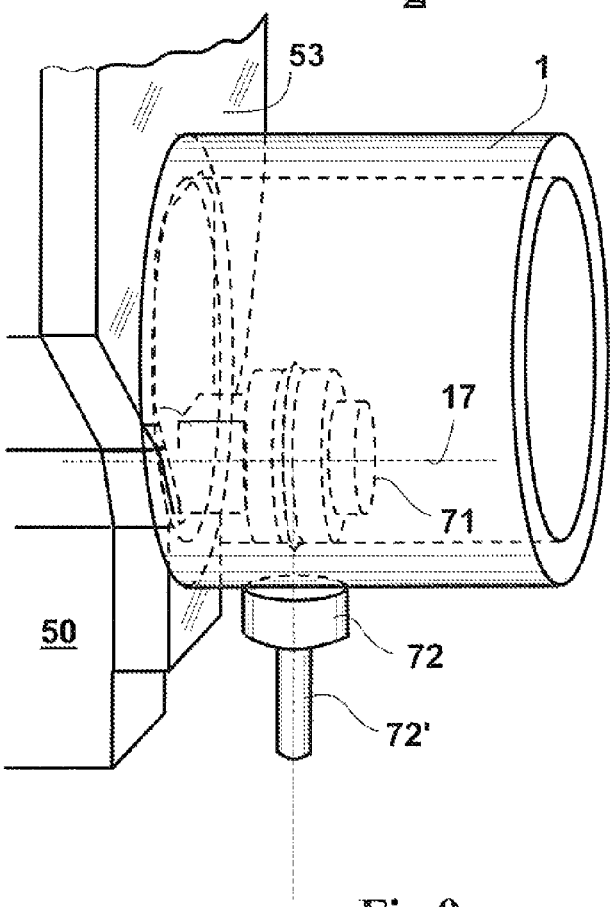
FIG. 7 shows the detail of FIG. 6 in a configuration of engagement with a tubular body to be sawn.
Figure 12:
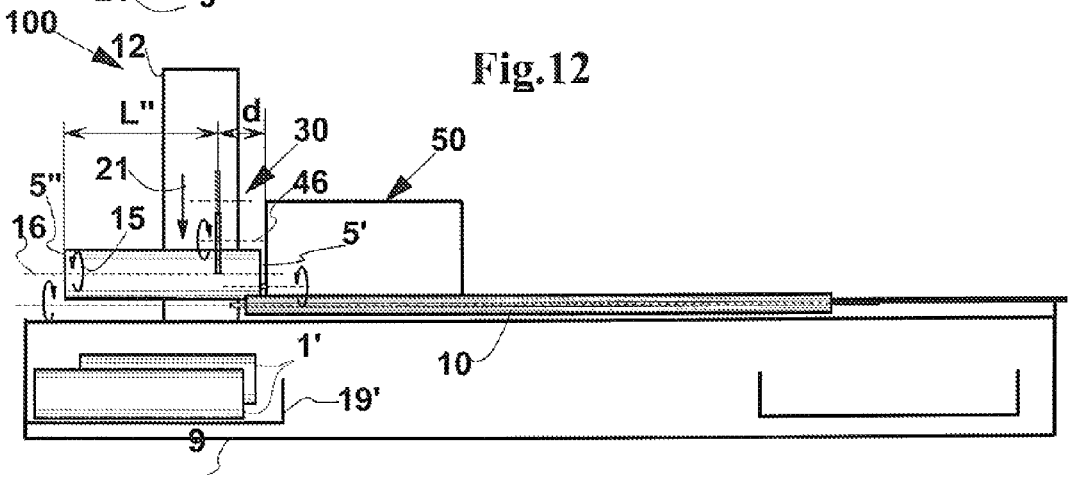
Figure 13:
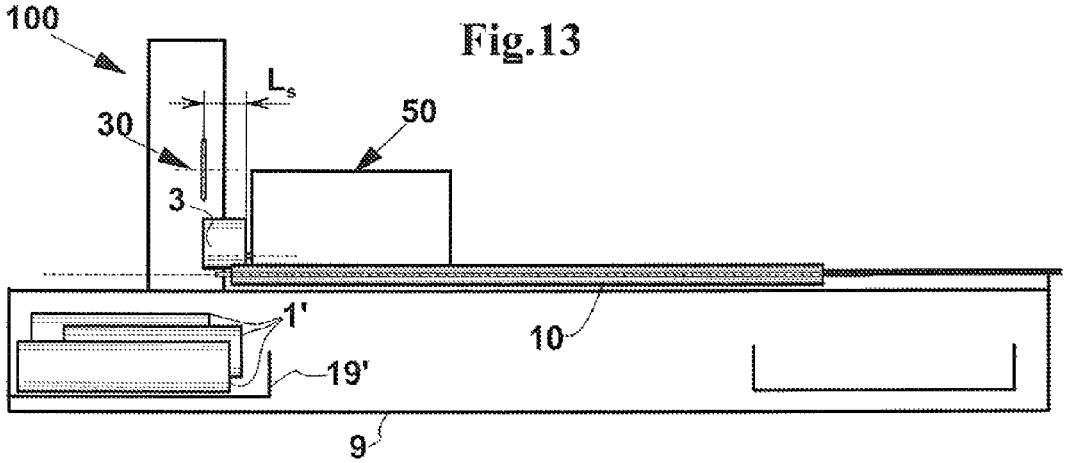
FIGS. 13 and 14 are side views of the apparatus of FIGS. 1-4 and 11-12, with a last tubular portion integral to the carriage means, in two different longitudinal positions.
Figure 14:
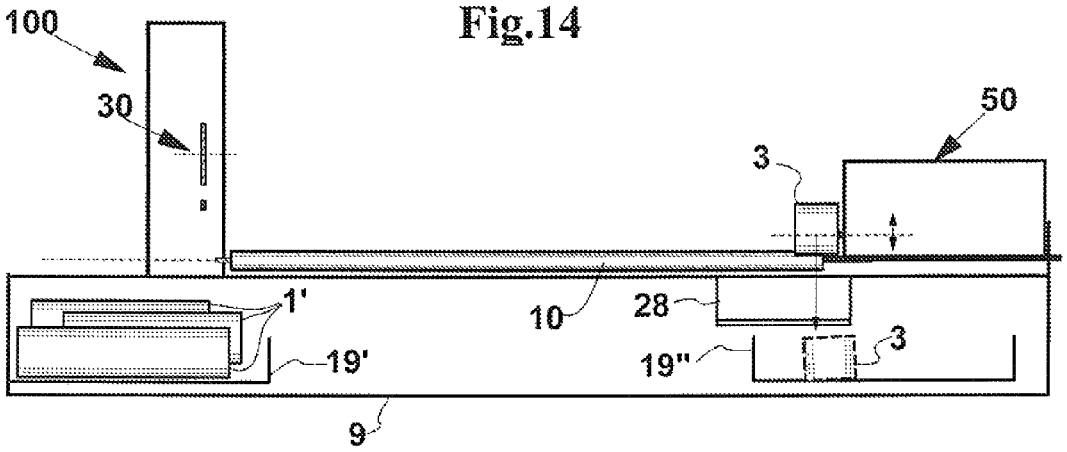

FIGS. 5 and 7 show the configuration of longitudinal holding means 14 when the same engages tubular body 1, for example while slide element 50 and tubular body 1 are moving forward towards sawing station 30 (FIG. 3) and while tubular body 1 is being sawn at sawing station 30 (FIGS. 4, 11, 12), or when a scrap portion 3 is recovered/withdrawn after the sawing (FIGS. 13, 14).

FIG. 10 shows the configuration of longitudinal holding means 14 while tubular body 1 is being sawn at sawing station 30 (FIGS. 4, 11, 12), in particular arrows 65' and 65" respectively show a possible rotation of rotatable element 71 and of tubular body 1 in the same sense, about their own longitudinal rotation axes 17 and 16.

Figure 8:
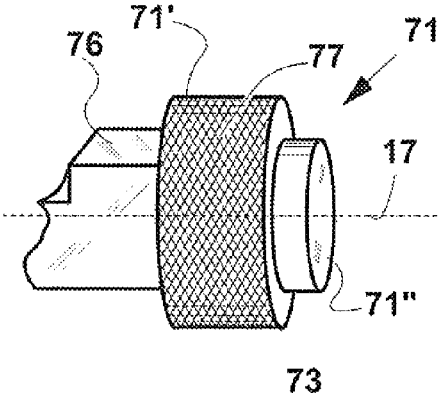
FIGS. 8 and 9 show a rotatable element of the longitudinal holding means according to two different exemplary embodiments of the gripping means for engagement with the inner surface of the tubular body.
Figure 9:
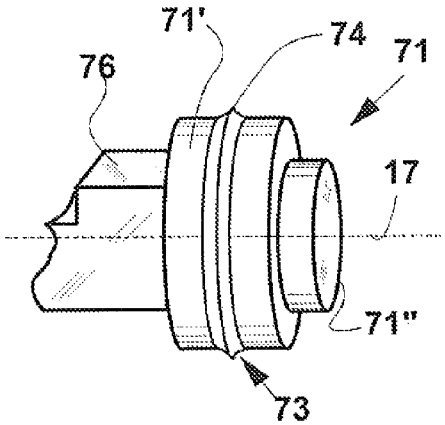

FIGS. 8 and 9 show two exemplary embodiments of rotatable element 71, in which a roller 71' is provided that is rotatably arranged about a hub 71", and a connection element, or stem, 76 to connect with the vertical shift movement actuation means, which is arranged within slide element 50.

In FIG. 8, roller 71' has a surface that has a finishing quality that is capable of causing a friction engagement with the inner surface of tubular body 1. This friction engagement is created in cooperation with the compression that is exerted on the wall of tubular body 1 when rotatable element 71 and countersupport member 72 are at their lowered position and raised position, respectively, as shown in FIGS. 5, 7 and 10. The friction that occurs, in these conditions, between the surface of rotatable element 71 and inner surfaces 18 of tubular body 1 can prevent the tubular body 1 from longitudinally shifting with respect to roller 50 and, therefore, with respect to slide element 50.

In FIG. 9, as well as in FIGS. 6 and 7, roller 71' is provided with an incision element 73 that is configured to engrave the material of inner surface 18 of tubular body 1. Preferably, incision element 73 comprises a continuous ridge or cutting edge 74 that extends along a circumference orthogonal to axis 17. The incision element may also comprise gripping elements of various shapes, for example a plurality of sharp elements that radially extend from the surface of roller 71. Since incision element 73 engraves surface 18 when rotatable element 71 is brought to its lowered position as shown in FIGS. 5, 7 and 10, it can prevent tubular body 1 from longitudinally shifting with respect to roller 50 and, therefore, with respect to slide element 50. The incision made by incision means 73 in the inner surface of tubular body 1, remains in the last tubular portion, i.e. in the scrap or waste portion 3, which is discharged into the scrap collection means 19" (FIGS. 13 and 14).

Figure 11:
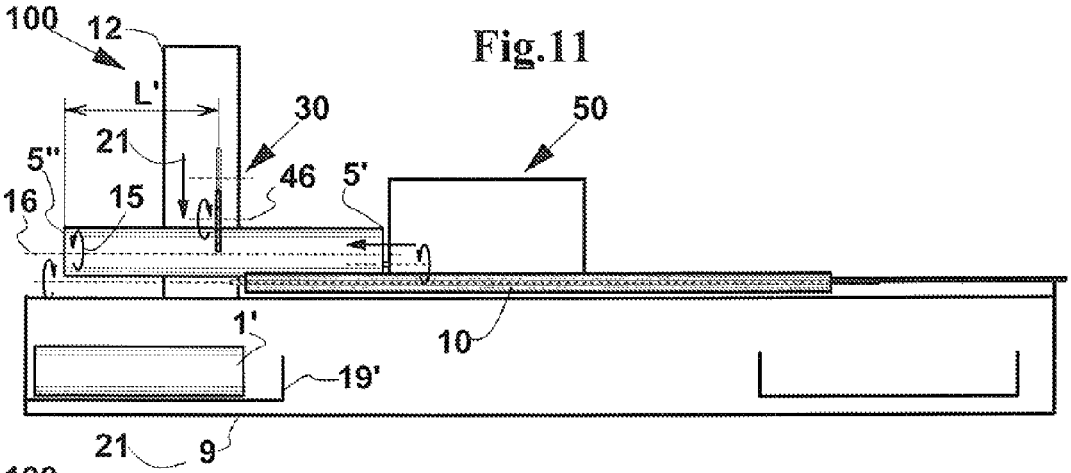
FIGS. 11 and 12 are side views of the apparatus of FIGS. 1-4, in a second and in a third transverse saw position of the tubular body.

From the sawing of tubular body 1, which is shown in FIG. 4, a sawn-away portion 1' is obtained that is collected in a possible sawn-away portions 1' container or collection area 19', as diagrammatically shown in FIG. 11.

Still with reference to FIG. 11, carriage means 50 is adapted to bring the new front end 5" of the remaining portion of tubular body 1 at a predetermined distance L', which corresponds to a predetermined sawing length of a second tube portion 1' to be sawn. Similarly, as shown in FIG. 12, carriage means 50 is configured to bring new front end 5" of the remaining portion of tubular body 1 at a predetermined distance L", which corresponds to a predetermined sawing length of a third tube portion 1' to be sawn. Consecutively sawn-away tube portions 1' and 1" are discharged in collection area 19' (FIG. 13). The subsequent movements of slide element 50 according to strokes L', L" are operated by the above-mentioned program means. The strokes or lengths L' and L" may be calculated by the program means, according to a prefixed production program.

As shown in FIG. 13, once all the prefixed sawing operations of tubular body 1 have been carried out, a last tubular portion 3 of length $L_s$ remains attached to carriage means 50 by means of longitudinal holding means 14. As described hereinafter, last tubular portion 3 may be connected with a new tubular body 1 in an apparatus equipped with a butt connection station for tubular bodies.

In alternative, according to the diagrammatical view of FIG. 14, last tubular portion 3 forms a waste or scrap portion that is collected into a scrap container or collection area 19", before being disposed or further transformed. As shown in FIG. 14, slide element 50 can carry scrap portion 3 to an unload position, which may substantially coincide with the load station of FIG. 2. At the unload station, a scrap unload and conveying means is provided for unloading and conveying scrap portion 3 to collection area 19", said scrap unload and conveying means comprising an inclined plane 28 that houses the scrap portion once it has been released by slide element 50.

Figure 15:
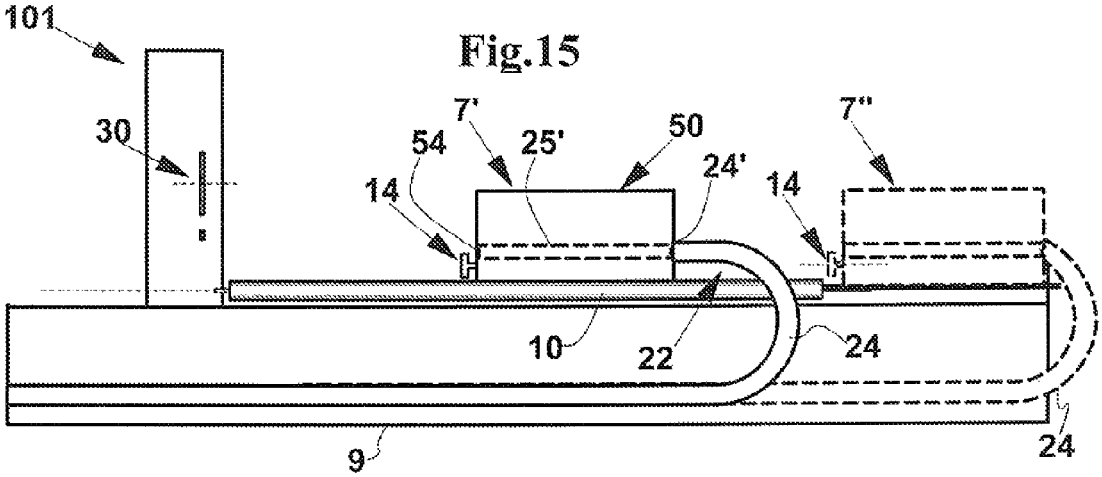
FIG. 15 shows an exemplary embodiment of the apparatus of FIGS. 1-4 and 11-14, equipped with a suction means for chips and other residues that are formed during a sawing operation.

FIG. 15 shows an apparatus 101, according to an exemplary embodiment, which comprises a suction means 22 for removing saw chips, sawdust and debris that are formed during the sawing operation, preventing them from piling up within the tubular body. Suction means 22 comprises a flexible duct that has an end 24' connected to an inner duct 25 of slide element 50, which is in turn connected to an opening of slide element 50 that may be pneumatically connected with the inside of tubular body 1, when tubular body 1 is held by holding means 14 of slide element 50. For instance, as shown in FIG. 7, inner duct 25 may be in connection with hole 54 of front plate 53, substantially tightly connectable with the inside of tubular body 1. Therefore, hole 54 serves as a flow aperture for removing the saw chips from the inside of tubular body 1. Flexible duct 22 has a portion integral to frame 9 of apparatus 101, and can follow slide element 50 with its end 24' when slide element 50 moves along apparatus 101, thus ensuring the saw chip suction at any position 7', 7" of slide element 50, in particular at any saw position.

Figure 16:
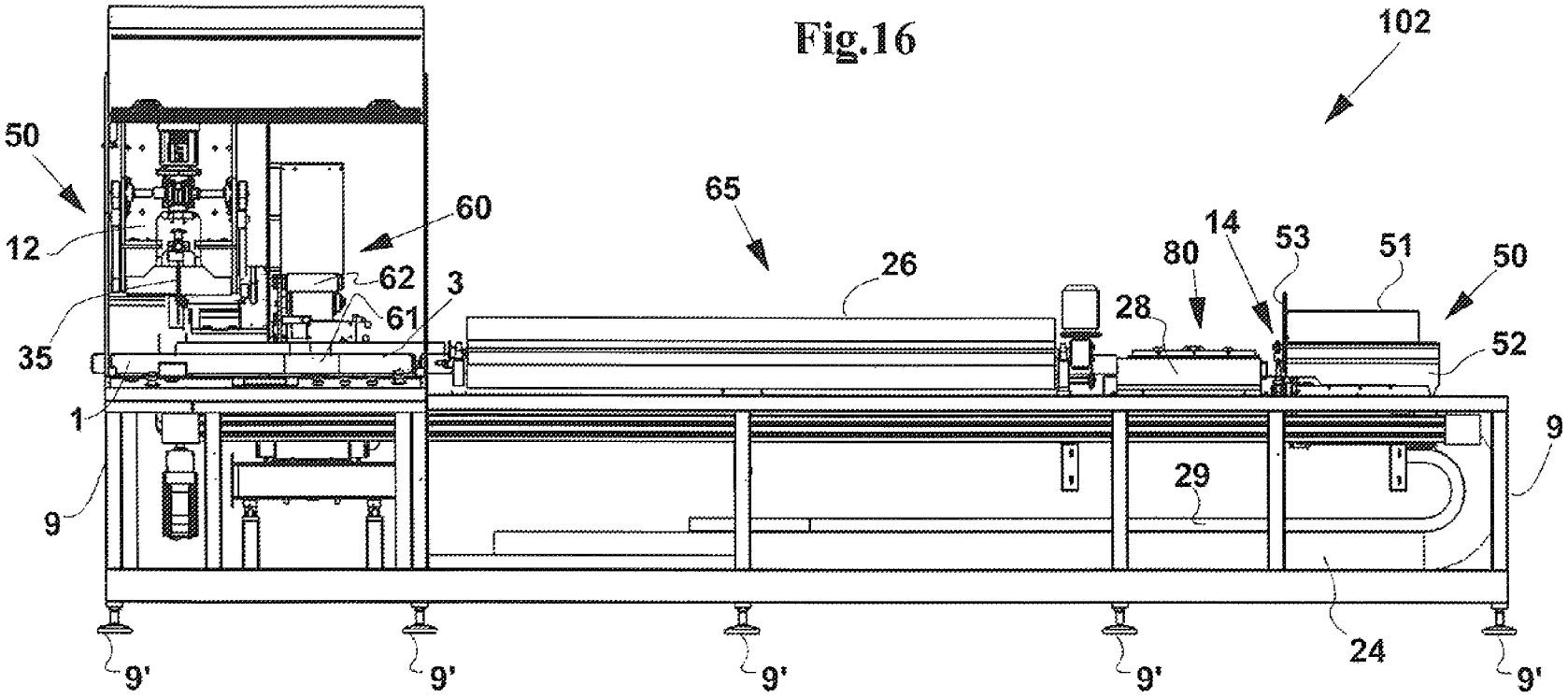
FIG. 16 is a side view of an apparatus according to another exemplary embodiment of the invention, comprising a connection station.

In FIG. 16 a saw and connection apparatus 102 is shown according to an exemplary embodiment of the invention. Apparatus 102 comprises a connection station 60 arranged to apply an adhesive tape 61 on adjacent end portions of two consecutive sawn-away tubular portions, or on adjacent end portions of a last tubular portion 3 (FIG. 13) and of a tubular body 1. Tape 61 may be taken from a roll 62 in a known way. Connection station 60 can create a butt connection between bodies 3 and 1 to form a connected tubular body, which may be used in subsequent sawing operations, according to a prefixed sawing length, at sawing station 30, close to connection station 60.

More in detail, last tubular portion 3 is brought by slide element 50 to a connection station of connection station 60 and is disengaged from the longitudinal holding means 71,72. Subsequently, slide element 50 is brought to the station of FIG. 1 again, and a new tubular body 1 is loaded. New tubular body 1 is kept held on slide element 50 by longitudinal holding means 71,72, as described above, by moving slide element 50 towards connection station 60, in order to abut its free end with the last tubular portion at connection station 60. Afterwards, a connection step is carried out, preferably by means of an adhesive tape and/or, preferably, by using a connection means of the type described in WO2008/114115, or in ITPI2007A000030.

Therefore, connection station 60 allows reducing the scraps. If desired, connection station 60 may be excluded from the operation schedule, in which case last tubular portion 3 is treated as a scrap or a waste material, as described with reference to FIGS. 13 and 14.

Frame 9 has feet 9' for fixing or laying the support on a ground or on a base frame. Independently from what described with reference to connection station 60, apparatus 102 may comprise a loading station 65 for loading tubular elements 1 to be sawn and/or to be connected on the support means, in the case shown on the cradle comprising a couple of parallel rotatable rollers 11',11". The loading station may comprise a driven star-shaped feeder 26, for example of the type described in detail in WO2008/114115.

Independently from the above description of connection station 60 and of loading station 65, apparatus 102 may comprise a scrap expulsion station 80 at a remote position with respect to sawing station 30, for example opposite to sawing station 30 with respect to loading station 65, i.e. at the position of slide element 50 that is at a maximum distance from saw means 35, i.e. at the position that is diagrammatically shown in FIG. 1 and in FIG. 2. In addition to inclined plane 28 of FIG. 14, scrap expulsion station 80 comprises a push means, which is described more in detail hereinafter.

Independently from positions 60, 85, 80, apparatus 102 is provided with the flexible tube, i.e. with a movable suction tube 24 extending as a rolling chain, which belongs to the chip suction means of FIG. 15. According to an exemplary embodiment, a flexible cable channel 29 is provided which encloses the cables for the electric actuation means and for the instruments that are arranged within slide element 50. Advantageously, flexible cable channel 29 is longitudinally adjacent to suction tube 24.

Carriage means 50 comprises a lower portion 52 and an upper portion 51 that slides on lower portion 55, according to a solution that is advantageous for treating large and small diameter tubes, as described hereinafter.

Figure 17:
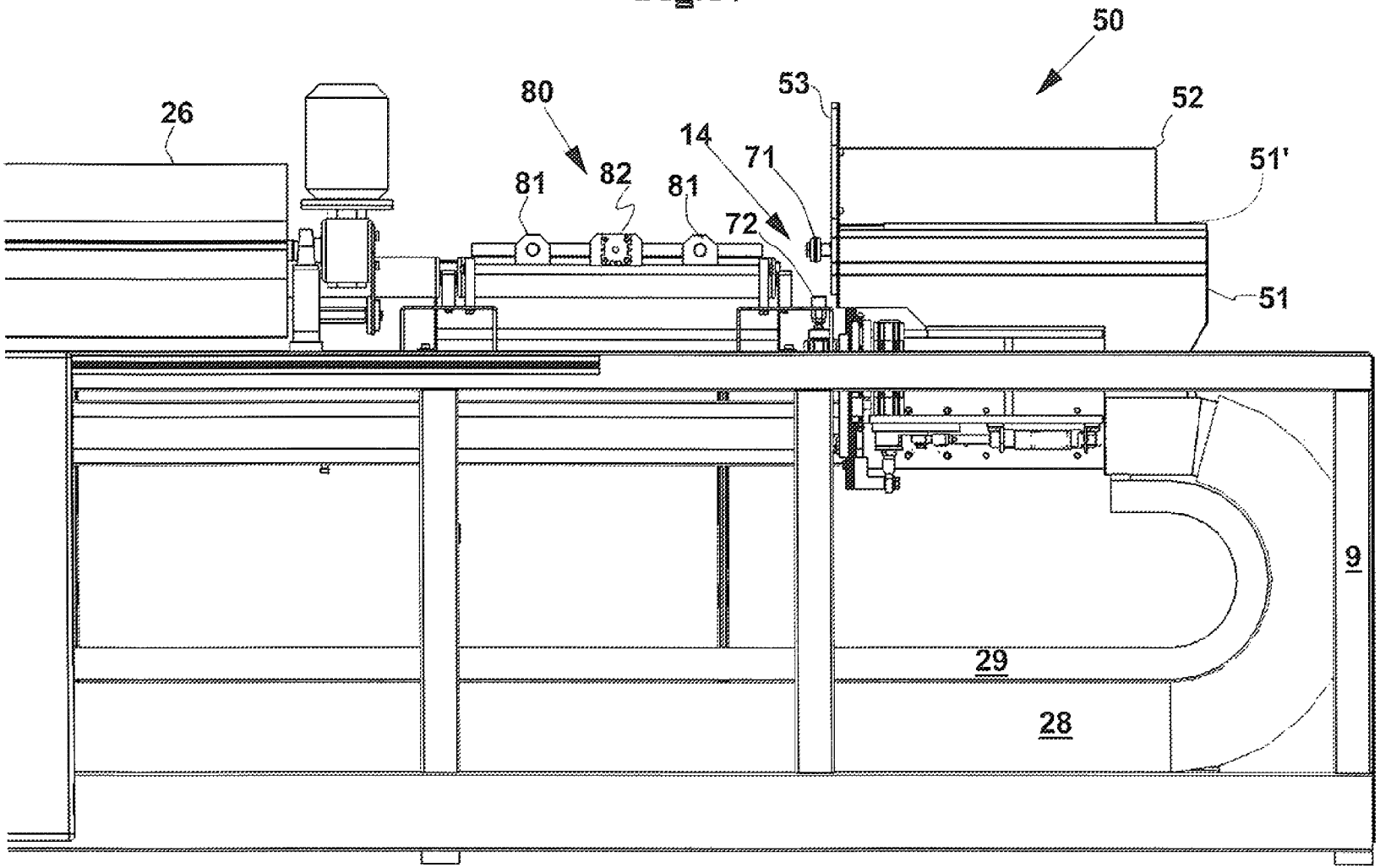
FIG. 17 is a side view of a detail of an apparatus similar to the apparatus of FIG. 16.

FIG. 17 is a detailed side view of apparatus 102 of FIG. 16. This figure shows more in detail scrap expulsion station 80, in which a push means is provided for transferring a scrap portion 3 (FIG. 14) from support 10 into the scraps collection area 19", through inclined plane 28. The push means comprises a push rod 81 arranged parallel to rollers 11',11", which may be moved by a cylinder-piston unit 82 between a rest position, at a side of support 10, and a push position, closer to the middle line of support 10, in order to push end portion or scrap portion 3 out of support 10. Two guide elements 83 are also provided for maintaining the orientation of push rod 81.

Figure 18:
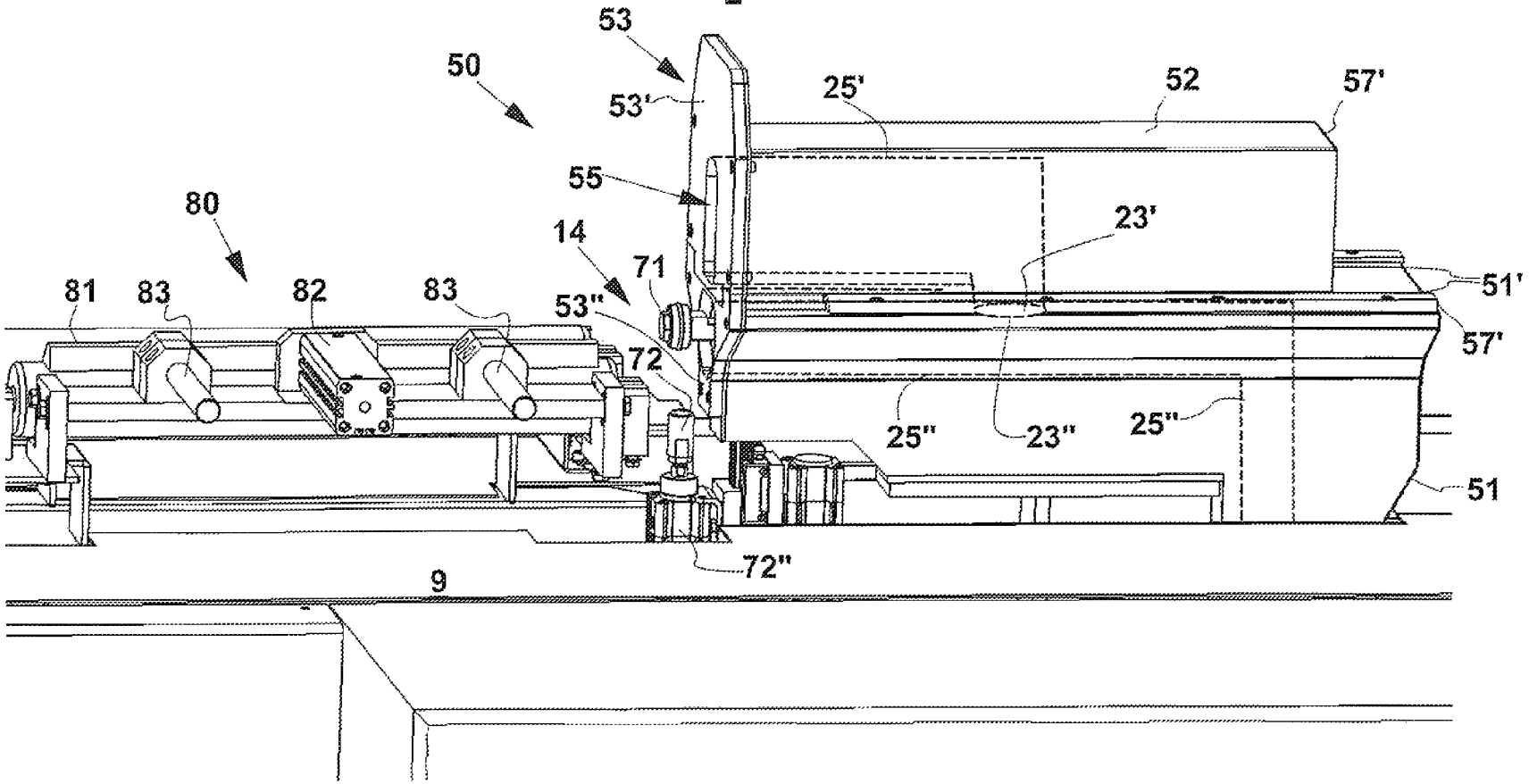
FIGS. 18 and 19 are partial perspective views of an apparatus similar to the apparatus of FIG. 16.

FIG. 18 is a further enlarged perspective view of the end portion of apparatus 102 shown in FIG. 17. A guide means 51' of upper portion 52 with respect to lower portion 51 is also shown. Upper portion 52 and lower portion 51 of slide element 50 comprise two respective front plates 53" and 53' which, in the position of FIG. 18, form a front plate as in FIGS. 6 and 7. Front plates 53" and 53' comprise respective holes 55 and 54 for sucking the chips from the inside of tubular body 1. As described above with reference to FIGS. 6 and 7, hole 54 also allows the movement of stem 76 of rotatable element 71. In case of tubes of larger diameter, as shown in FIG. 19, upper portion 52 is arranged with front plate 53' aligned with front plate 53" of the lower portion. This way, the suction is carried out through both holes or flow apertures 54 and 55, which form the end portions of ducts 25' and 25" in slide element 50, respectively. Duct 25' has a lower end opening 23', while duct 25" has an opening 23" made through an own upper wall. When upper portion 52 of slide element 50 is in the aligned position of FIG. 18, apertures 23', 23" form a passageway that allows connecting duct 25" with the saw chip suction means. When upper portion 52 of slide element 50 is in a different position than the aligned position of FIG. 18, for instance when rear faces 57', 57" of slide element portions 51, 52 are aligned with each other, apertures 23', 23" are spaced apart from each other, in such a way that the above passageway is blocked, and duct 25" is excluded from the saw chip suction means. This configuration is well suited for the case of small diameter tubular bodies, not shown.

Figure 19:
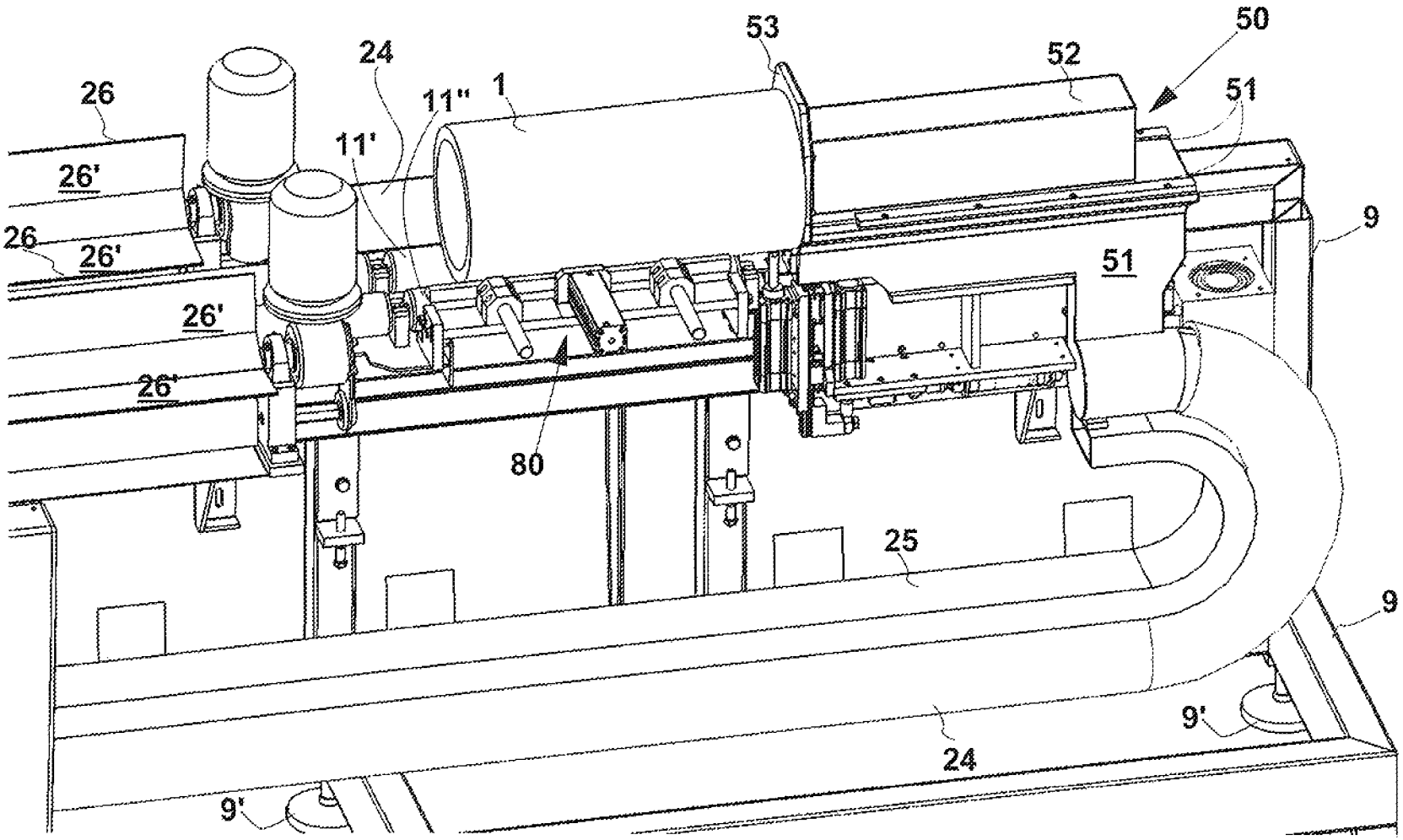

FIG. 19 is a perspective view similar to the view of FIG. 18, where a tubular body 1 is shown arranged upon a couple of rollers 11',11" of support 10 (FIG. 1). The diameter of tubular body 1 may be large enough to engage with saw chip suction channel 23', in the upper portion of the slide element. FIG. 19 also shows more closely a portion of loading station 65, comprising two star-shaped feed member 26, each comprising a plurality of protrusions 26'.

The foregoing description of specific exemplary embodiments will so fully reveal the invention according to the conceptual point of view, such that others, by applying current knowledge, will be able to modify and/or adapt in various applications this specific exemplary embodiments without further research and without parting from the invention, and, then it is meant that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. An apparatus for transversally sawing a tubular body into tubular portions, for use as tubular cores for coils of wound material, the apparatus comprising:

a carriage means for moving said tubular body through a sawing station, said carriage means arranged to engage with a first end of said tubular body and to longitudinally move said tubular body until a second end of said tubular body reaches a predetermined distance from said sawing station, said distance corresponding to a predetermined sawing length of a tube portion;

a support means that is arranged to receive said tubular body at said sawing station, and to allow an idle rotation of said tubular body about its own longitudinal axis at said sawing station;

a rotation means for bringing into rotation and maintaining in rotation said tubular body about said longitudinal axis when said tubular body is located at said sawing station on said support means;

a saw means for sawing said tubular body at said sawing station, in order to obtain a sawn-away portion of said tubular body of the same length as said distance, wherein said carriage means comprises a holding means for holding said tubular body when said tubular body is moved longitudinally along said support means, said holding means comprising:

a rotatable element extending from said carriage means and arranged to relatively rollingly engage with a surface portion of said tubular body; and a counter-support member arranged to vertically slide between a lowered position in which it is disengaged from said tubular body, and a raised position in which it clamps, in cooperation with said rotatable element, said tubular body.

2. The apparatus according to claim 1, wherein said rotatable element is arranged to engage by rolling and pressing onto an inner surface portion of said tubular body proximate to said first end.

3. The apparatus according to claim 2, wherein said rotatable element is arranged to engage by rolling and pressing onto an inner surface portion of said tubular body proximate to said first end and radially corresponding to a surface portion of said tubular body that is in contact with a counter-support element.

4. The apparatus according to claim 1, wherein said carriage means is configured to translate parallel to said support means between a first position, at a maximum distance from said sawing station, and a second position, at a minimum distance from said sawing station, wherein a loading means is provided for loading a tubular body to be sawn at a load position set between said first position and said second position.

5. The apparatus according to claim 1, wherein said saw means comprises a circular saw that is rotatably arranged about an axis configured for being arranged parallel to said longitudinal direction.

6. The apparatus according to claim 5, comprising a suction means for removing chips that are produced by said saw means, said suction means arranged in said carriage means, in order to suck at said first end chips that are produced at said second end through said tubular body.

7. The apparatus according to claim 6, wherein said carriage means comprises a plate configured to be arranged adjacent to said first end, and said suction means comprises a flow aperture in said plate, said flow aperture configured to provide an air suction mouth towards said first end.

8. The apparatus according to claim 6, wherein said suction means comprises a fixed suction station that is connected to a movable tube extending as a rolling chain from said carriage means, in order to accumulate the sucked chips in said fixed suction station.

9. The apparatus according to claim 1, wherein said rotatable element is a roller configured to rotatably and frictionally engage with said inner surface portion.

10. The apparatus according to claim 1, wherein said rotatable element has a profile configured to emboss the material of the inner surface of said tubular body, to make a rolling track for said rotatable element that provides a precise longitudinal reference.

11. The apparatus according to claim 10, wherein said rotatable element has an incision means that is configured to make a circular notch in said inner surface, said incision means comprising a cutting edge that extends circumferentially along said rotatable element.

12. The apparatus according to claim 1, wherein said support means comprises two elongated rollers longitudinally and rotatably arranged parallel to each other, in order to receive said tubular body laying by gravity and parallel onto said rollers, and said inner surface portion of said tubular body, with which said rotatable element is arranged to engage, is a lower portion of said inner surface portion, wherein a passageway for said carriage means is provided between said rollers.

13. The apparatus according to claim 1, wherein an adjustment means is provided for adjusting the radial position of said rotatable element with respect to said tubular body, said adjustment means configured to cause said rotatable element to rollingly engage with an inner surface portion of said tubular body by pressing on it, said portion having a predetermined thickness.

14. The apparatus according to claim 13, wherein said radial position adjustment means is arranged to retain said rotatable element at a central position and a recall means for recalling said rotatable element towards a peripheral position into contact with said inner surface portion of said tubular body.

15. The apparatus according to claim 1, wherein a scrap expulsion station is provided at a first movement position of said carriage means at a remote position with respect to said sawing station, wherein said scrap expulsion station comprises a pusher configured to push said scrap portions transversally with respect to a conveying direction of said carriage means.

* * * * *